United States Patent [19]

Gerbert-Gaillard et al.

[11] Patent Number: 4,468,645

[45] Date of Patent: Aug. 28, 1984

[54] MULTIPOLE CIRCUIT BREAKER WITH REMOVABLE TRIP UNIT

[75] Inventors: Alain Gerbert-Gaillard, Vourey; Robert Morel, Eybens, both of France

[73] Assignee: Merlin Gerin, Grenoble, France

[21] Appl. No.: 418,422

[22] Filed: Sep. 15, 1982

[30] Foreign Application Priority Data

Oct. 5, 1981 [FR] France ..... 81 18840

[51] Int. Cl.[3] ..... H01H 73/06

[52] U.S. Cl. ..... 335/42; 335/176

[58] Field of Search ..... 335/8, 9, 21, 22, 24, 335/42, 43, 45, 35, 145, 172, 176; 337/70, 53, 82

[56] References Cited

U.S. PATENT DOCUMENTS 3,265,837 8/1966 Klein ..... 337/50

FOREIGN PATENT DOCUMENTS 1513257 3/1965 Fed. Rep. of Germany .

319019 3/1957 Switzerland .

*Primary Examiner*—J. D. Miller

*Assistant Examiner*—George Andrews

*Attorney, Agent, or Firm*—Parkhurst & Oliff

[57] ABSTRACT

The present invention relates to a disconnectable connection between a trip unit and circuit breaker. The disconnectable connections between the removable trip unit and the circuit breaker unit include inclined connection lugs so as to provide access to the set-screws of the connections on the narrow side face of the circuit breaker casing.

6 Claims, 5 Drawing Figures

MULTIPOLE CIRCUIT BREAKER WITH REMOVABLE TRIP UNIT

BACKGROUND AND SUMMARY OF THE INVENTION

The invention relates to an electric circuit breaker, in particular with moulded casing, having a circuit breaker unit for housing the contacts and the operating mechanism of said contacts, and a removable trip unit for housing the thermal and/or magnetic tripping elements associated with the different poles to actuate the mechanism for tripping in case of overload and/or fault. The trip unit for each pole includes a section of power conductor electrically series connected by a disconnectable connection to an associated section of conductor of the circuit breaker unit enclosing the contacts. The tripping elements react to the over-currents and short-circuit of currents flowing through the conductors.

It is known to dispose a range of trip units of different tripping characteristics, with the trip unit being selectively associated with the same circuit breaker unit to constitute circuit breakers of different ratings. When the trip unit is mounted the electrical connection of the power conductors is ensured by tightening connection screws. These screws are inserted between the trip unit and the braid of current supply to the movable contact to permit their access from the front of the circuit breaker, thereby requiring an extension of the conductors and circuit breaker casing. The trip unit fixing is furthermore carried out independently of the electrical connection, thus complicating the user's or distributor's task.

The suppression of the disconnectable connection was already proposed by providing a detection magnetic circuit in two separable parts, one rigidly locked with the trip unit and the other with the circuit breaker unit. This solution is interesting for a thermal trip with current transformer but it is difficult to apply it to a trip device with bimetallic strip carried by a heater.

An object of the present invention is to remedy these disadvantages and to permit the realization of a circuit breaker with a trip unit that is easily removable and has reduced over-all dimensions.

According to the present invention, the disconnectable connection of each conductor includes a connecting lug making an acute angle with the trend of the conductors in the circuit breaker.

The disposition according to an oblique line of the connection lugs permits an oblique disposition of the set-screws and the access holes to the set-screws which are perpendicular to the lugs. These set-screws emerge no longer on the front of the circuit breaker by crossing the whole length of the casing, but rather, on the side face supporting the connecting terminals. The over-all dimensions are thus lengthwise reduced to the detriment of the over-all dimensions in height, but the available room in this zone is sufficient to place the inclined lugs under the mechanism of the trip unit.

At the same time that the set-screws advantageously ensure the fixing of the trip unit on the circuit breaker unit, the connection lugs of one of the units is elastically mounted thereon to compensate for positioning faults and to permit a right contact of the lugs of the three poles of the circuit breaker. The inclined lugs are disposed in the lower part of the trip unit to make the access to these set-screws easier and to ensure a right fixing of the unit. The conductor section associated with the trip unit is turned in loops to cross the magnetic circuit of the electromagnetic release and ends by the inclined connection lug located below this magnetic circuit. This lug is brought into contact with the associated lug supported by the base of the circuit breaker unit when the trip unit release is mounted. The connection zone is thus brought back under the trip unit and the electrodynamic forces generated inside the loop increase the contact pressure of the lugs.

BRIEF DESCRIPTION OF THE DRAWINGS

Other advantages and technical data will more clearly appear from the following description, wherein reference is made to the accompanying drawings, in which.

DETAILED DESCRIPTION OF THE PREFERRED EMBODIMENT

Figure 1:
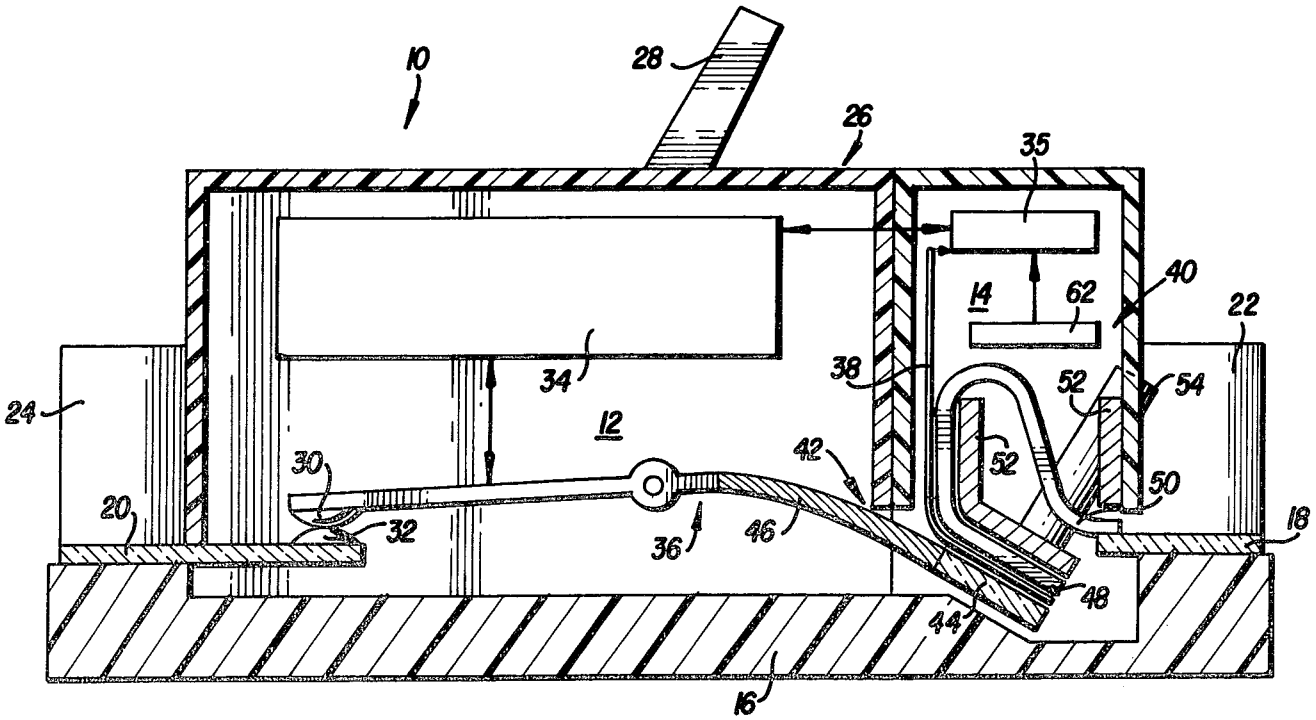
FIG. 1 is an elevational schematic view of a circuit breaker according to the invention, the side face of the casing being removed.
Figure 3:
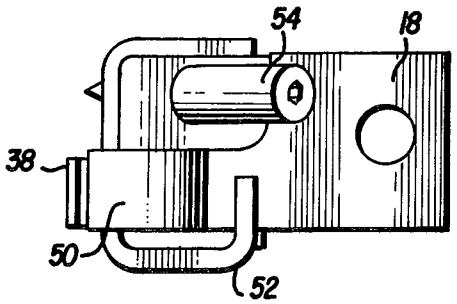
FIGS. 3 and 4 are plane and side views of FIG. 2 respectively.
Figure 5:
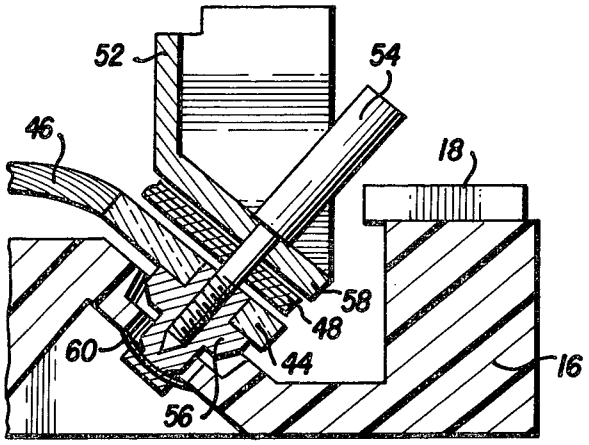
FIG. 5 is a sectional view, similar to FIG. 2, taken along the plane containing the connection screw, the trip unit being secured on the base.
Figure 2:
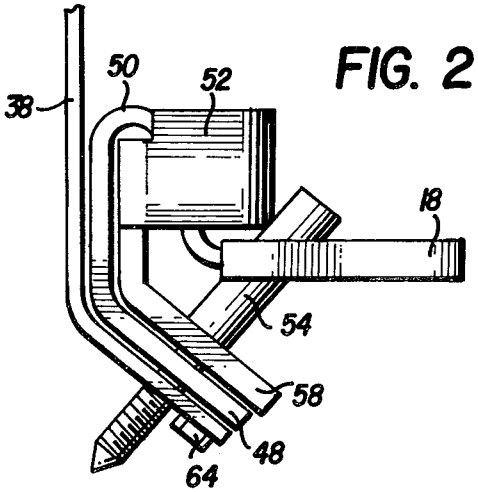
FIG. 2 is a detailed view on a magnified scale of FIG. 1, showing the lower part of the trip unit.
Figure 4:
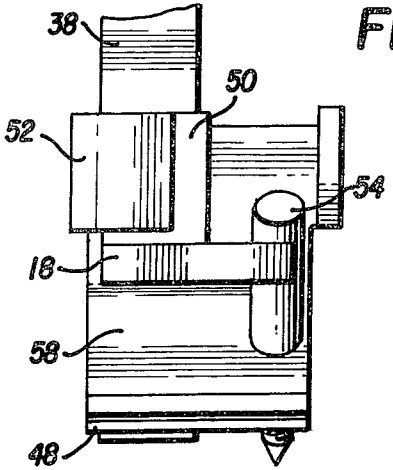

With regard to the figures, a preferred embodiment of a multipole circuit breaker 10, for instance a three-phase circuit breaker, includes a circuit breaker unit 12 and a trip unit 14 on a base 16 belonging to the circuit breaker unit 12. The base 16 supports the entrance and output connecting terminals 18, 20 of the circuit breaker, capped by removable terminal covers 22, 24. The circuit breaker which has the general form of a parallelipiped is equipped on its front 26, opposite to the base 16, with a handle 28. Inside the circuit breaker unit 12 are located three pairs of separable contacts 30, 32 as well as the operating mechanism 34 which induces the displacement of the movable contacts 30 in the switch-off and switch-on positions when the handle is hand-operated. The operating mechanism 34 is automatically opened upon the occurrence of a tripping order of a bar 35 of the trip unit 14. The mechanism 34 and the connections between this mechanism 34 and the movable contacts 30 and the trip unit 14 are schematically represented in FIG. 1. It is noted that the trip unit 14 includes a push finger transversely shifted by the bar 35 to protrude from the side wall of the trip unit for actuating the operating mechanism 34. The finger is retracted within the trip unit 14 in the rest position. Removal of the trip unit is accomplished by lifting the trip unit upwardly in FIG. 1 while it is in the rest position.

The contacts 30, 32 of each pole are inserted in a power conductor 36 which extends between the terminals 18, 20 along the base 16 and crosses the trip unit 14. The trip unit 14 contains for each pole a thermal release 38 and an electromagnetic release 40 which induce the circuit breaker tripping in case of overload and short-circuit respectively. The trip unit 14 is removable and a range of trip units of different characteristics may be mounted on the same circuit breaker unit. The terminals or lugs 18 are secured on to the trip unit 14 and removed with the latter. Each conductor 36 includes a connection 42 disconnectable in the junction zone of the circuit breaker unit 12 and the trip unit 14. The connection 42 is broken by the removal of trip unit 14.

According to the present invention, the disconnectable connections 42 are disposed in the lower part of the trip unit 14 and each of them includes a connection lug 44 inclined for instance by an angle close to 45° with the trend relative to the conductor 36, i.e. of the base 16. The lug 44 belongs to the circuit breaker unit 12 or more exactly it is float mounted on this unit by being connected by a braid 46 to the movable contact 30. On this lug 44 is tightened, in secured position of the trip unit 14, the end 48 of a section 50 of the conductor 36 which crosses the trip unit 14. The opposite end of the section 50 is connected to the terminal 18 and the section 50 extends inside the trip unit 14 according to a loop trajectory. The section 50 crosses a U-shaped yoke 52 of the magnetic circuit of the electromagnetic release 40. Referring more particularly to FIGS. 2 through 5, it can be seen that the width of section 50 is less than the width of terminal 18, for instance by half, so as to clear a passage for a set-screw 54. The end 48 is widened to face the lug 44 and the set-screw 54 crosses aligned apertures accommodated in the end 48 and the lug 44 before being screwed in a nut 56 carried by the base 16. The section 50 is made of foil to present some flexibility and a support strap 58 linked on to the yoke 52 is inserted between the screw (not shown) 54 head and the end 48. The yoke 52 is rigidly fastened, for instance by a set-screw, on the casing of the trip unit 14, while the nut 56 is elastically mounted on the base 16 by a spring 60. The armature 62 of the electromagnetic release is located in front of the yoke 52 while the bottom of the bimetallic strip 38 is fastened to the assembly of end 48 and straps 58 by a fastening screw 64. The set-screw 54 perpendicularly extends to the lug 44 by being inclined and emerging on the narrow side face of the trip unit 14 on the side of the terminals 18 in a zone covered by the terminal cover 22.

The trip unit 14 includes a disconnectable connection 42 for each conductor 36, i.e. three connections in the case of the triple-pole circuit breaker. The float assembly of the lugs 44 permits an effective tightening and a right electrical contact on the ends 48 and the straps 58 when the set-screw 54 and nut 56 are screwed, together in spite of the unavoidable positioning faults relative to the three straps 58. It is clear that after a tightening of the set-screw 54 and nut 56, the trip unit 14, the straps 58, the lugs 44 and the nuts 56 form a rigid assembly fastened to the base 16 by the springs 60 which smooth the positioning faults of the straps 58. By choosing springs 60 of a sufficient rigidity the trip unit 14 is fixedly attached to the circuit breaker unit 12 by simple tightening of the set-screw 54 and nut 56 which ensures at the same time the electrical connection.

In the example illustrated by the figures, the bimetallic strip 38 is heated by contact with the conductor 36, but it will be noted that the invention applies to circuit breakers with bimetallic strips heated by the current or to bimetallic strips indirectly heated by a winding supported by the yoke 52. The magnetic release 40 may also be of a different type and the disposition of the connection lug, in particular the value of the inclination, can be different without going beyond the present invention. The elastic mountings smoothing the positioning faults over may be provided on the parts rigidly locked with the trip unit 14 without modifying the invention. The expression connection lug is used in the above description in its general sense of a zone, but this lug is not necessarily a rigid plane surface.

The mounting and dismantling of the trip unit do not require any skill or special knowledge and can be effected by the user or the distributor, thereby permitting a reduction of circuit breakers stocks. The right tightening of the three screws reveals a proper fixing and a right electrical connection of the trip unit. After mounting and sealing of the terminal cover, the connection screws become inaccessible. Other tightening means besides screws can be considered, the main point being that the access to these tightening means from the side face of the circuit breaker casing reduces the casing length. The fixing screw is not necessarily shifted laterally, since the passage through a central aperture of the conductor is possible by insulating the conductor screw by any appropriate means, for instance by interposition of an insulator or use of a screw of insulating material.

The invention is not at all limited to the embodiments more fully described and shown on the accompanying drawings, but on the contrary it extends to any realizations remaining in the limit of the equivalences.

What is claimed is:

1. A multipole electric circuit breaker with a molded housing including a bottom wall and two end walls, comprising a circuit breaker unit including separable contacts and an operating mechanism for said contacts, and a removable trip unit including tripping elements associated with the different poles for actuating said operating mechanism in case of overload and fault, said trip unit comprising, for each pole, a first section of a power conductor having at one end a disconnectable connection part, and said circuit breaker unit comprising, for each pole, a second section of a conductor enclosing the contacts and having at one end another disconnectable connection part, the conductor in the circuit breaker unit extending generally parallel to said bottom wall, the connection of the pair of connection parts providing the series connection of said first and second sections of power conductor, said disconnectable connection parts each having a connection end making an acute angle with the trend to said conductor in the circuit breaker unit.

2. The circuit breaker according to claim 1, wherein each pair of disconnectable connection parts comprises a tightening piece in two parts, one part being secured to the trip unit and the other part being secured to the circuit breaker unit so as to ensure in the tightened position the electrical connection of said connection parts and the mechanical fixing of the trip unit on the circuit breaker unit.

3. The circuit breaker according to claim 2, wherein the connection parts and one of the parts of the tightening pieces carried by one of the units are elastically mounted thereon to compensate for the positioning irregularities of the connection parts of the different poles.

4. A multipole electric circuit breaker with a molded housing including a bottom wall and two end walls, comprising a circuit breaker unit including separable contacts and an operating mechanism for said contacts, and a removable trip unit forming one of the end walls of the circuit breaker and including tripping elements associated with the different poles for actuating said operating mechanism in case of overload and fault, said trip unit comprising for each pole a first section of a power conductor having at one end an output terminal disposed on the side of said one end wall and at the other end, a disconnectable connection part, said circuit breaker unit comprising for each pole a second section of a power conductor enclosing the contacts and having at one end another disconnectable connection part, the connection of the pair of disconnectable connection parts providing the series connection of said first and second sections of power conductor, said disconnectable connection parts being located near said bottom wall and making an acute angle with said bottom wall, said disconnectable connection parts including tightening pieces accessible from said one end wall.

5. The multipole circuit breaker according to claim 4, wherein each pair of disconnectable connection parts comprises a tightening piece having two parts, one part being secured to the trip unit and the other part being secured to the circuit breaker unit so as to ensure in the tightened position the electrical connection of said connection parts and the mechanical fixing of the trip unit on the circuit breaker unit, the connection parts and one of the parts of the tightening pieces carried by one of the units being elastically mounted thereon to compensate for the positioning irregularities of the connection parts of the different poles.

6. The multiple circuit breaker according to claim 5, comprising a terminal cover capping the output terminals of the circuit breaker and the access to the tightening piece.

* * * * *